United States Patent [19]

Heater et al.

[11] Patent Number: 4,609,030

[45] Date of Patent: Sep. 2, 1986

[54] METHOD OF INCREASING PRODUCTIVITY OF CASTING VEE CONFIGURATION ENGINE BLOCKS IN A GIVEN MOLD

[75] Inventors: Thomas J. Heater, Garden City; Murray P. Donnelly, Dearborn Heights, both of Mich.

[73] Assignee: Ford Motor Company, Dearborn, Mich.

[21] Appl. No.: 805,655

[22] Filed: Dec. 6, 1985

[51] Int. Cl.[4] ..... B22D 33/04

[52] U.S. Cl. ..... 164/137; 164/23; 249/123; 249/160

[58] Field of Search ..... 164/23, 28, 29, 44, 164/45, 137, 340, 379, 6, 13, 15, 27, 32, 351; 260/119; 249/123, 126, 135, 119, 160, 176, 180, 122, 134

[56] References Cited

U.S. PATENT DOCUMENTS

| | | | |
|---|---|---|---|
| 2,783,510 | 3/1957 | Dolza et al. . | |
| 3,435,886 | 4/1969 | Walter | 164/340 |
| 3,572,418 | 3/1971 | Keller | 164/32 |

*Primary Examiner*—Nicholas P. Godici
*Assistant Examiner*—G. M. Reid
*Attorney, Agent, or Firm*—Joseph W. Malleck; Roger L. May

[57] ABSTRACT

A method is disclosed for increasing productivity when casting Vee configuration engine blocks in a given size, two-part refractory mold having a single parting plane. The method comprises (a) preparing an assembly of refractory cores consisting of (i) one or more pairs of crankcase cores siamesed together and presenting core faces in opposite directions (ii) two pairs of complimentary barrel slab valley cores nested respectively into two pairs of complimentary water jacket cores to form two pairs of complimentary barrel core nests (each pair of complimentary barrel core nests is preferably adapted to be mounted on one of said faces of a crankcase core) (iii) a pair of cam tunnel cores, each cam tunnel core being insertable onto a face of a crankcase core and sandwiched between a pair of barrel core nests to define a Vee angle between said barrel core nests with the bisector of said angle passing through the cam tunnel core and (iv) a pair of dual end cores stationable at each end of the crankcase core transverse to the core faces; (b) planting the assembly of said refractory cores in the mold to define a casting cavity and having the bisector of each of the Vee angles aligned with the mold parting plane; and (c) pouring molten metal into said cavity to form a pair of engine block castings.

11 Claims, 6 Drawing Figures

METHOD OF INCREASING PRODUCTIVITY OF CASTING VEE CONFIGURATION ENGINE BLOCKS IN A GIVEN MOLD

BACKGROUND OF THE INVENTION

1. Field of the Invention

This invention relates to metal casting technology and particularly to the casting of complex Vee configuration engine blocks.

2. Description of the Prior Art

Cast iron engine cylinder blocks of the Vee configuration are typically cast in one of two positions, either an upsidedown position in the mold (sometimes referred to as pan rail up) or in an upright position (often referred to as in the car position). The mold cavity for these blocks is split along a horizontal parting plane forming an upper and a lower mold portion, and is comprised of compacted grain sand which is molded over a male pattern. A limitation of this mold forming process is that any flanges, ribs or bosses on the sides of the engine block casting must be drafted or loaded in the direction that the pattern is withdrawn from the mold. On Vee configuration blocks having an included angle of about 90°, this limitation results in a weight penalty. On 60° Vee configuration cylinder blocks this weight penalty is even more severe due to the narrower bank angle and the need for various stiffening ribs at the transmission end of the block. An illustration of the conventional manner of making Vee configuration engine blocks is shown in U.S. Pat. No. 2,783,510. It shows the extent to which drafting must be exaggerated to accommodate Vee angles, here being 110°, and thus resulting in a weight penalty.

To eliminate some of such loading from bosses and stiffening ribs, thereby creating a weight penalty, the prior art has resorted to using mold inserts in the form of side mold parts which will define the necessary side wall features of the casting. While these additional mold inserts provide product features at a lesser weight, they do significantly increase the variable cost of the casting due to the need to produce handle and set additional mold inserts in the mold assembly.

What is needed is a process of casting such Vee configuration blocks so that the draft angle for flanges, ribs or bosses can extend in a direction transverse to the axis of the Vee angle and yet eliminate the necessity for mold inserts of any type while eliminating unnecessary weight additions due to accommodating unnecessary draft angles and, at the same time, increasing productivity of a given size refractory mold by permitting a greater number of castings to be made in such given mold.

SUMMARY OF INVENTION

The invention is a method of increasing productivity for casting Vee configuration metal engine blocks for an internal combustion engine in a given size, two-part refractory mold having a single parting plane. The method comprises: (a) planting a plurality of siamesed refractory core assemblies in a two-part chill mold having a single parting plane, each said assembly of refractory cores in cooperation with said mold defining an engine block casting cavity with a Vee angle configuration, each said casting cavity having the bisector of the Vee angle aligned with said mold parting plane; and (b) introducing molten metal to said cavities to form solidified engine block castings.

In more particularity, the method comprises: (a) preparing a a male pattern adapted to occupy the space required for (i) paired casting cavities defining two engine blocks, both cavities having barrels arranged wtih a Vee-inclined angle therebetween, (ii) two refractory core assemblies fitting respectively within and about said cavities of said male pattern, the core assemblies being connected in siamese fashion, and (iii) a gating system for delivering molten metal to the cavities; (b) molding cope and drag refractory mold parts about the male pattern, said mold parts having a single parting plane and being effective without the use of mold inserts; (c) removing the male pattern from the mold parts after separation of the mold parts along the parting plane; (d) planting said siamesed core assemblies and gating system into said mold parts in a position to define said paired casting cavities with the bisection of the Vee angles being aligned with the parting plane; (e) introducing molten metal into the gating system and thence the cavities to form a pair of solidified block castings; and (f) removing and separating said castings from said mold parts.

The method can be restricted to the steps of core assembly preparation and planting of such core assemblies and, in this regard, the two refractory core assemblies preferably consist of: (a) (i) one or more pairs of crankcase cores with the bottom of each siamesed together and presenting core faces in opposite directions (ii) two pairs of complimentary barrel slab valley cores nested respectively into two pairs of complimentary water jacket cores to form two pairs of complimentary barrel core nests, each pair of complimentary barrel core nests being adapted to be mounted on one of said faces of a crankcase core (iii) a pair of cam tunnel cores, each cam tunnel core being insertable onto a face of a crankcase core and sandwiched between a pair of barrel core nests to define a Vee angle between the barrel core nests with the axis of said angle passing through the cam tunnel core and (iv) a pair of dual end cores stationable at each end of the crankcase core transverse to the core faces; (b) planting the assembly of said refractory cores in the mold to define a casting cavity and having the axis of each of the Vee angles aligned with the mold parting plane; and (c) pouring molten metal into said cavity to form a pair of engine block castings.

Preferably the flanges, ribs or bosses on the cores of the core assembly are drafted and loaded in a direction normal to the parting plane and coincident with the direction of insertion or withdrawal of the core assembly from the mold; preferably the Vee angle which is included between the barrel core nests is in the range of 50°–90° and each of said cores is comprised of resin bonded sand.

Preferably the thickness of the siamese section between the crankcase cores (and forming an integral part thereof) is in the range of 4–6 inches.

Preferably the weight of a casting of a typical block produced by this method can be decreased by at least 10% by elimination of bulk due to the draft angle constrictions.

Although not preferred, the aspect ratio of the core assembly when compared to the aspect ratio of the mold is about 3/2 to 2/1. In this manner, the pair of siamesed core assemblies occupy the space generally occupied by a single core assembly. This can increase productivity within a given size mold by at least an additional 100%.

SUMMARY OF THE DRAWINGS

FIG. 3 is a view similar to that of either FIGS. 1 or 2, but representing this invention and again showing a fragmentary schematic view of a section of a mold illustrating the orientation of the spaces for multiple core assemblies therein.

DETAILED DESCRIPTION

Internal combustion engine cylinder blocks are of a massive nature, particularly for six and eight cylinder engine blocks, and have intricate internal passages. Such a complex, heavy casting is further complicated when a Vee configuration block is to be cast. Vee configuration is an engine block having two rows of in-line cylinder bores with the axes of the bores of both rows passing through a common line; to do so, the rows of bores are oriented with an included angle therebetween usually in the range of 60°–90°.

Figure 1:
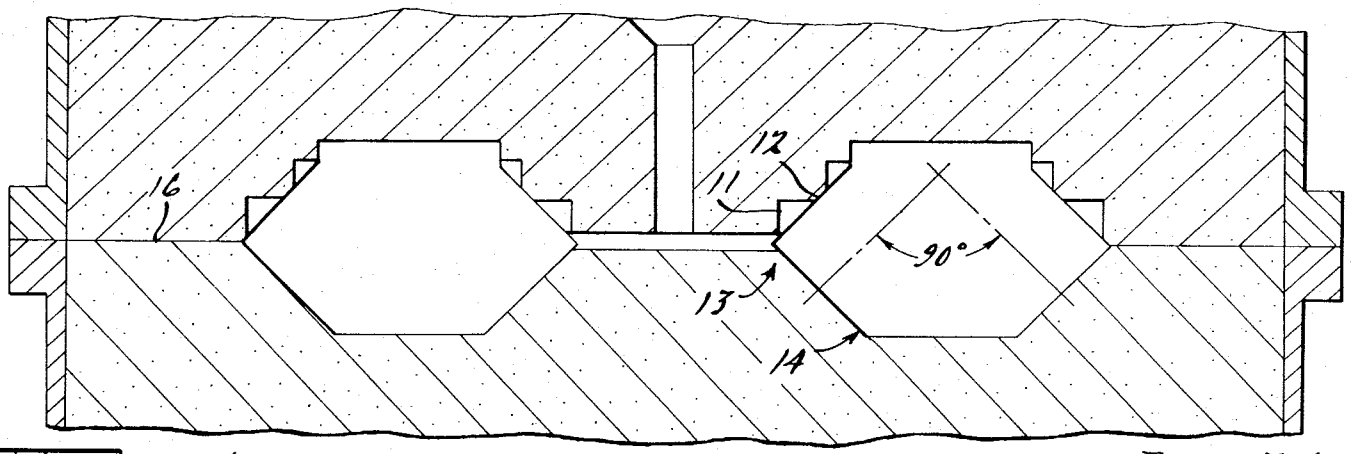
FIGS. 1 and 2 each represent different embodiments of the prior art in casting conventional Vee configuration cast iron blocks; the views are fragmentary, schematic sections through a mold showing the positioning of the spaces to be occupied by core assemblies within a green sand mold.
Figure 2:
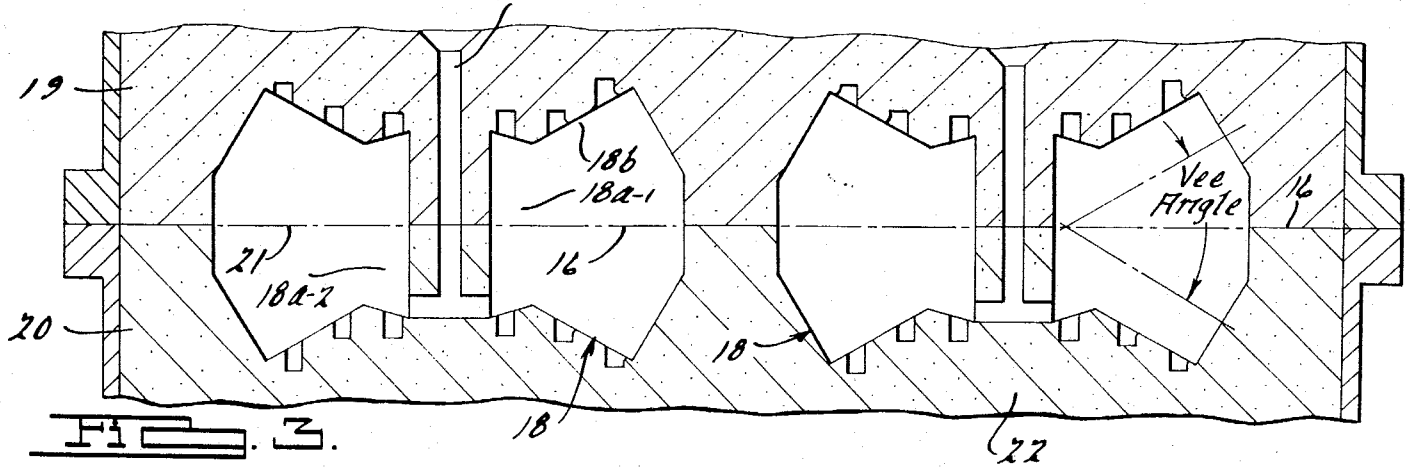
Figure 2:
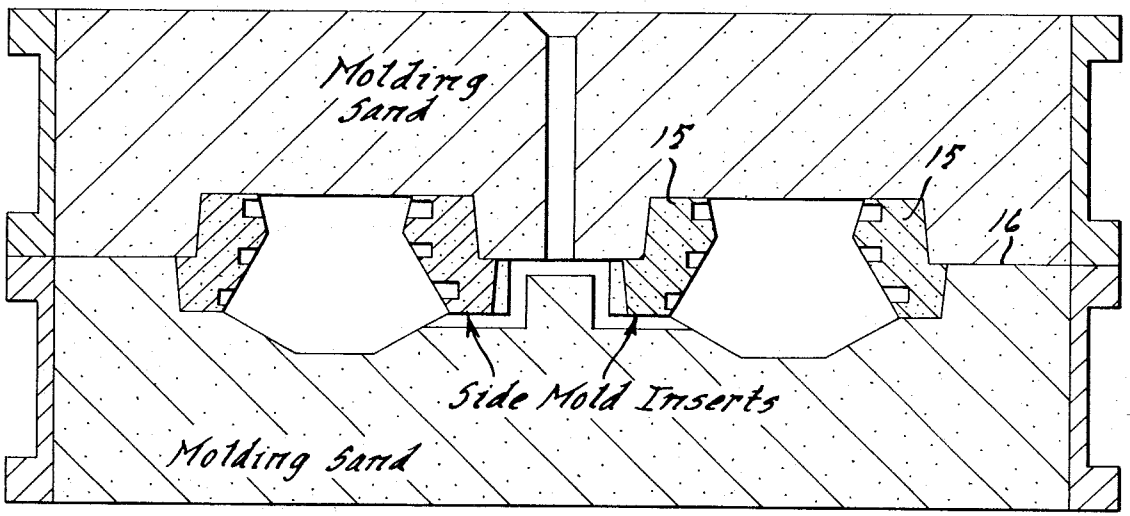
Prior Art FIG. 2.

In the past, cast iron engine cylinder blocks of the Vee configuration which have been used commercially have been cast in one of two positions, either upsidedown in the mold, or right side up in what is often referred to as the car position. Typically, a given-sized production mold permits two of these Vee configuration engine cylinder blocks to be cast together in the same mold, such as shown in FIG. 1. The mold cavity for these blocks is formed by compacting green sand over a male pattern, the sand being split along a horizontal parting plane 16 to define a cope and drag; then a chemically bonded core assembly is planted in the space, left by removal of the male pattern, to cooperate in defining the cavity. Notice that the flanges, ribs or bosses 11 on the sides 12 of the casting must be drafted or loaded in the direction 13 that the pattern is withdrawn from the mold, that is, a vertical direction as shown in FIG. 1. The blocks 14 shown in FIG. 1 are in the car position with a Vee angle of 90° pointed downwardly. With 90° Vee angle cylinder blocks, the drafting angles result in a weight penalty, that is, the flanges, ribs or bosses 11 are increased in size to allow for the draft angle to be in the upright direction. On 60° Vee angle cylinder blocks, this weight penalty is even more severe due to the narrower bank angle and the need for various stiffening ribs at the transmission end of the block. As a result, 60° angle blocks are often cast in the upsidedown position and mold inserts 15 are employed to form the necessary side wall features (see FIG. 2); such mold inserts can be withdrawn in a direction along the parting plane 16 instead of transverse to it. While these additional mold inserts provide the flanges and ribs at a minimum weight, they do increase the variable cost of the casting due to the need to produce, handle and set such mold inserts.

To reduce process costs in the forming and handling of sand cores, to reduce the weight of the Vee configuration block casting, and to increase productivity of the number of castings that can be cast within a given size mold, the inventive process herein uses two principal features: (a) it eliminates mold inserts by aligning the bisector or axis of the Vee angle with the parting plane of a two-part mold; and (b) increases productivity and lowers production costs by inserting two or more siamesed core assemblies within a single mold having a single parting plane by inserting such siamesed core assemblies in place of a single core assembly used heretofore.

Figure 4:
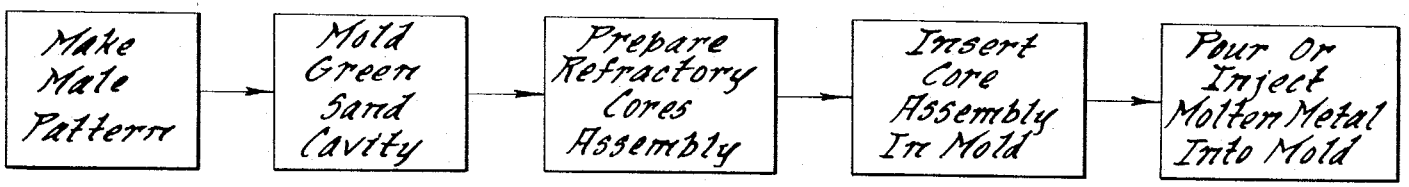
FIG. 4 is a flow diagram of the process of this invention.

Turning to FIGS. 3 and 4, the method more particularly comprises: (1) preparing a male pattern 18 which is comprised of a member that occupies the space of siamesed core assemblies **18*a*-1 and 18*a*-2, metal casting cavities between the core assemblies and mold and metal delivery channels 18*c* which form a gating system; (2) molding the two-part mold (cope 19 and drag 20) around the male pattern, after which the male pattern is removed by separation of the cope and drag; (3) preparing refractory cores which fit together as an asembly 60 within the space left by the male pattern (see FIG. 6), the cores, in cooperation with the mold, being effective to define a Vee configuration engine block cavity 18*b* (each core assembly 60 has a pair of crankcase cores 23–24 siamesed together, complimentary in-line slab barrel cores 32–33, and complimentary in-line water jacket cores 38–39 adapted to be nested together to form in-line barrel nests, a cam tunnel core 43** adapted to be inserted between each pair of in-line barrel nests and pairs of end cores); (4) assembling the cores into said assemblies by nesting the in-line barrel cores into the in-line water jacket cores to form a barrel nest, sandwiching a cam tunnel core between two in-line barrel nests to form a first assembly, mounting a first assembly onto one face of the crankcase core assembly, and completing the core assembly by adding the end cores thereto, the core assemblies are planted or inserted into the mold; and (5) pouring or injecting molten metal into the mold to occupy the casting space between the core assembly and mold.

PREPARING MALE PATTERN

The male pattern 18 is prepared to comprise a body that occupies space of the engine block casting **18*b*, refractory core assembly 60, and the metal delivery channels (gating system) 18*c*. The male pattern is typically comprised of machined cast iron or steel. The refractory core assembly 60, which is described in more detail in the following steps, is characterized by having two refractory core subassemblies 18*a*-1 and 18*a*-2 paired together in a siamesed connection. Both Vee configuration blocks are arranged to have the axis or bisector 21 of the Vee angle lying in the parting plane 16 of the sand mold 22**.

MOLDING THE GREEN SAND CAVITY

The male pattern 18 is stationed in the mold and green sand is compacted therearound to define cope 19 and drag 20 which meet at a parting plane 16. The green sand is bonded together by pressure. After the molded sand is firmly compacted and shaped, the mold parts are separated and the male pattern is removed leaving a cavity 18*b* therebehind which receives both the core assemblies and the molten metal.

PREPARING THE REFRACTORY CORE ASSEMBLIES

Figure 5:
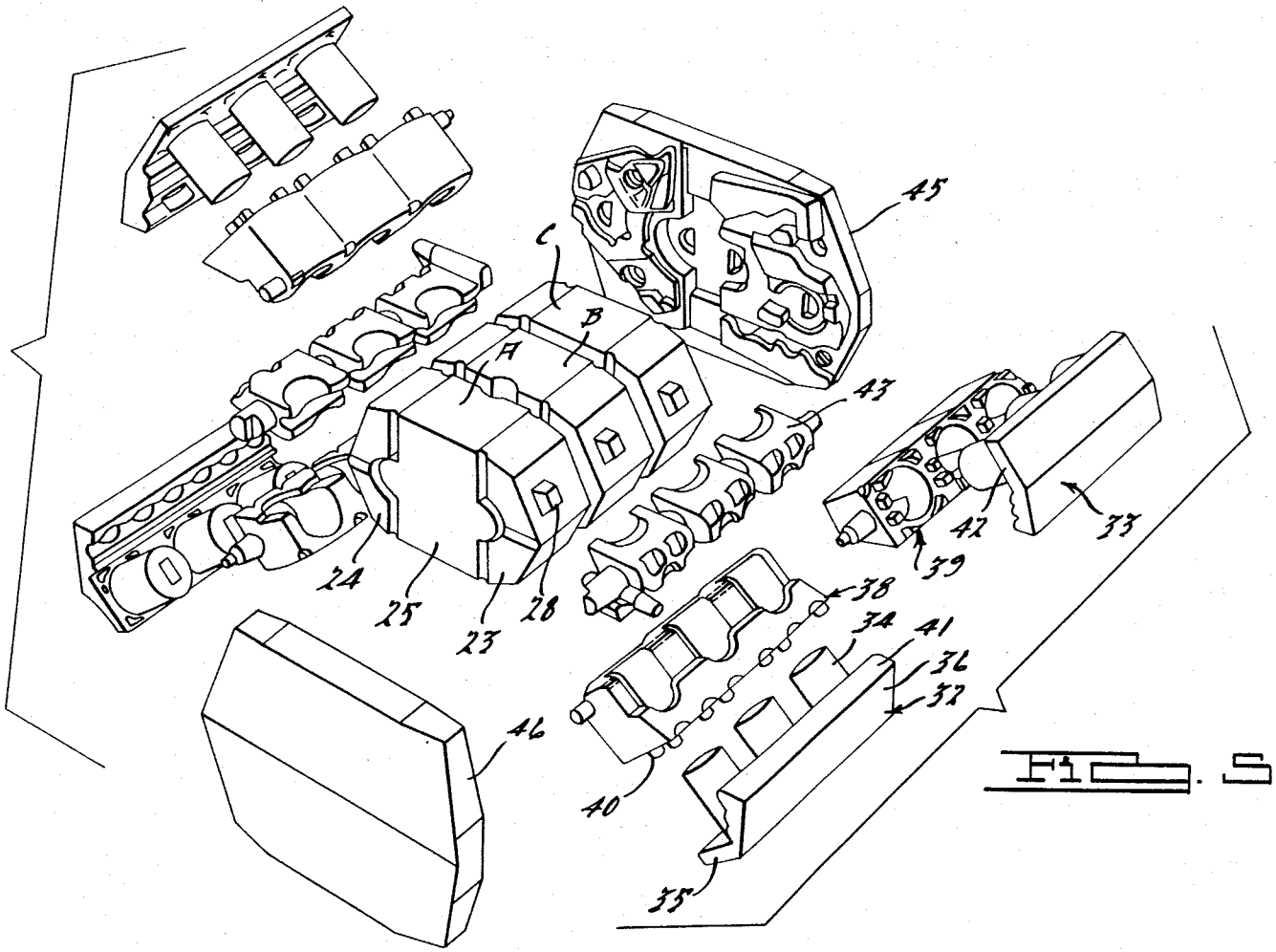
FIG. 5 is an exploded, perspective view of one siamesed core assembly shown in FIG. 3.
Figure 6:
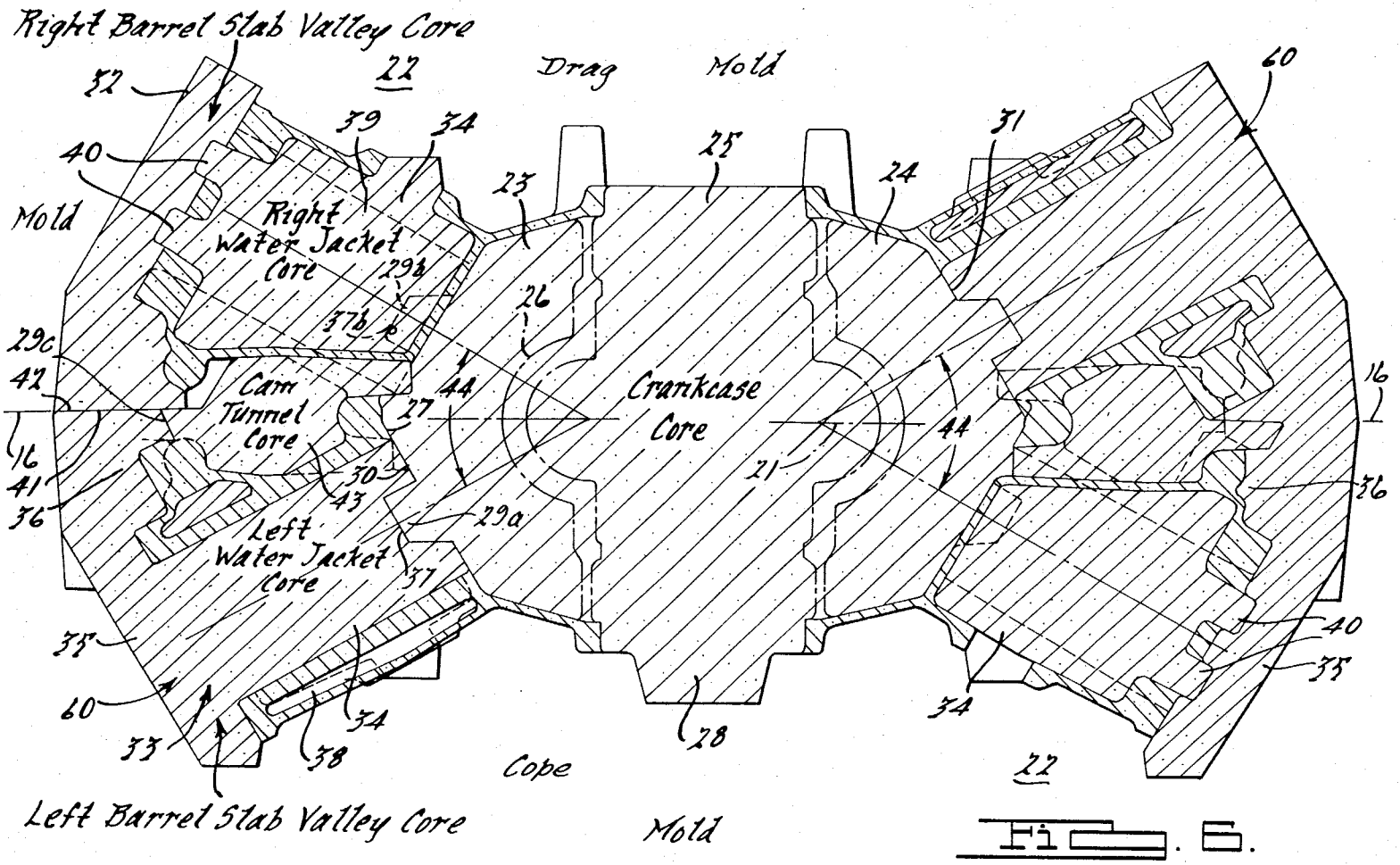
FIG. 6 is an enlarged sectional view of one siamesed core assembly illustrated in FIG. 3 and taken along a plane perpendicular to the mold parting plane in FIG. 3.

As shown in FIGS. 5 and 6, one of the core assemblies 60 is comprised of a pair of crankcase cores 23–24 siamesed together at a section 25; the crankcase cores may be sliced into parts A-B-C, but together they define the interior housing surface 26–27 (see FIG. 6) and have projections 28 which key into the mold and projections 29 *a- b* which serve as keys for receiving the other cores. The surface 26 is designed to define the crankcase bearing journal of the casting. The siamesed crankcase cores present faces 30–31, each in opposite directions. The thickness of the siamese connection at 25 is in the range of 4–6 inches.

Two pairs of complimentary (complimentary herein means elements which are substantially mirror images, such as right and left barrel assemblies arranged as arms of a Vee configuration) barrel slab valley cores 32–33 are prepared, each with a series of in-line barrel portions 34, capped by a top slab 35 which has an inwardly projecting valley portion 36. Each of the barrel slab valley cores have female openings 37 *a-b* to receive the keys 29 *a-b* of the crankcase core. Two pairs of complimentary water jacket cores 38–39 are prepared to receive the nest within the slab valley cores. Each of the water jacket cores has a series of keys 40, adapted to receive the slab portions 32; these are assembled into barrel slab valley cores. Complimentary (right and left) barrel slab valley core assemblies are designed to be fitted together at the inner surface 41–42 of the valley portions 36, and a cam tunnel core 43 is prepared, sandwiched between each pair of barrel slab valley cores set at a predetermined Vee angle 44. Each of the cam tunnel cores define chambers through which a cam shaft may extend and be supported in a metal casting.

Lastly, a pair of dual end cores 45–46 (see FIG. 5) are prepared to fit at opposite ends of the series of crankcase cores.

INSERTING THE CORE ASSEMBLY IN THE MOLD

As shown in FIG. 6, the cores are assembled and this assembly is inserted within the cope and drag of the mold. This is carried out by first mating the water jacket cores 38–39 to the barrel slab valley cores 32–33 to form jacket barrel slab valley core assemblies. The drag side jacket barrel slab valley core assembly is nested to the crankcase cores, such as at face 30. The cam tunnel cores are then nested to the subassembly at face 29*c*. The cope side jacket barrel slab valley core assemblies are nested to the subassembly at the crankcase cores at face 30 and the drag side jacket barrel slab valley core at faces 41–42. The pair of dual end cores are mounted on opposite ends of the crankcase, cam tunnel, and jacket barrel slab core subassembly; the subassemblies are accurately aligned therein by mating of the keys together.

The core assembly provides a set of cores to define two Vee configuration engine blocks. The core assembly is planted in the mold cavity in the proper relationship after the cope and drag have been separated. Most importantly, the axis of the Vee angle for each said core assembly is aligned with the parting plane of the mold.

The weight of the metal casting resulting from practicing the method is reduced by the elimination of added metal bulk normally required to have draft angles for protuberances extending transverse to the axis of the Vee angle.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of metal casting, comprising:

(a) planting a plurality of siamesed refractory core assemblies in a two-part mold having a single parting plane, each said assembly of refractory cores in cooperation with said mold defining an engine block casting cavity with a Vee angle configuration, each said casting cavity having the bisector of said Vee angle aligned with said mold parting plane; and (b) introducing molten metal to said cavities to form solidified engine block castings.

2. The method as in claim 1, in which said Vee angle is in the range of 50°–90°.

3. The method as in claim 2, in which the aspect ratio of said core assembly to the aspect ratio of said mold is about 3/2 to 2/1.

4. The method as in claim 1, in which said mold is a sand mold having a horizontal parting plane substantially bisecting said mold.

5. A method of increasing productivity for casting Vee configuration metal engine blocks for an internal combustion engine in a given size, two-part refractory mold having a single parting plane, comprising the steps of:

(a) preparing a a male pattern adapted to occupy the space required for (i) paired casting cavities defining two engine blocks, both cavities having barrels arranged with a Vee angle therebetween (ii) two refractory core assemblies fitting respectively within and about said cavities of said male pattern, the core-assemblies being connected in siamese fashion and (iii) a gating system for delivering molten metal to said cavities;

(b) molding cope and drag refractory mold parts about said male pattern, said mold parts having a single parting plane without the use of mold inserts;

(c) removing said male pattern from the mold parts after separation of said mold parts along said parting plane;

(d) planting said siamesed core assemblies and gating system into said mold parts in a position to define said paired casting cavities with the bisector of said Vee angles being aligned with said parting plane;

(e) introducing molten metal into said gating system and thence the cavities to form a pair of solidified block castings; and (f) removing and separating said castings from said mold parts.

6. The method as in claim 5, in which said Vee angle is in the range of 60°–90°.

7. A method of increasing productivity of casting Vee configuration metal engine blocks for an internal combustion engine, in a given sized two-part refractory mold having a single parting plane, comprising:

(a) preparing an assembly of refractory cores consisting of (i) one or more pairs of crankcase cores siamesed together and presenting core faces in opposite directions (ii) two pairs of complimentary barrel slab valley cores nested respectively into two pairs of complimentary water jacket cores to form two pairs of complimentary barrel core nests (iii) a pair of cam tunnel cores, each cam tunnel core being insertable onto a face of said crankcase core and sandwiched between a pair of barrel core nests to define a Vee angle between said barrel core nests with the axis of said angle passing through said cam tunnel core and (iv) a pair of dual end cores stationable at each end of the crankcase core transverse to said core face;

(b) planting said assembly of said refractory cores in said mold to define a casting cavity and having the bisector of each of said Vee angles aligned with said mold parting plane; and (c) pouring molten metal into said cavity to form a pair of engine block castings.

8. The method as in claim 7, in which said refractory cores are comprised of resin bonded sand.

9. The method as in claim 7, in which any flanges, ribs or bosses defined on said cores of said assembly are drafted and loaded in a direction normal to the parting plane and coincident with the direction of insertion or withdrawal of the core assembly for the mold.

10. The method as in claim 7, in which each said siamesed core assembly occupies the space generally occupied heretofore by a single engine block core assembly, whereby productivity of each given size mold is at least doubled.

11. A method of increasing productivity of casting Vee configuration metal engine blocks for an internal combustion engine in a given size refractory mold, comprising:

(a) preparing a male pattern which is adapted to occupy the space occupied by two casting cavities, two refractory core assemblies interconnecting said cavities, and a gating system for delivering molten metal to the two casting cavities;

(b) molding a cope and drag around said male pattern with a single parting plane, said cope, drag and male pattern together defining said casting cavities, and subsequently removing the male pattern from the split mold;

(c) preparing a refractory core assembly to fit within the space occupied by said male pattern, except for said casting cavities, said refractory core assembly comprising a pair of oppositely facing crankcase cores siamesed together by a spacing section to form a crankcase core assembly having opposite faces, two pairs of complimentary in-line barrel cores, and two pairs of complimentary in-line water jacket cores adapted to be nested together to form two pairs of barrel nests, a pair of cam tunnel cores, designed to be sandwiched between a pair of complimentary barrel nests, and a pair of dual end cores;

(d) assembling said cores together to form a core assembly by first mating the barrel nests and sandwiching a cam tunnel core therebetween to form two pairs of in-line dual cylinder nests, and mounting said in-line dual barrel assemblies onto opposite faces of said crankcase core assembly, with an included Vee angle therebetween, to form dual cores assemblies effective to define two engine blocks; and (e) pouring or injecting molten metal into the mold to form metal castings between said mold and core assemblies.

* * * * *